US007088946B2

(12) United States Patent
Behnke et al.

(10) Patent No.: US 7,088,946 B2
(45) Date of Patent: Aug. 8, 2006

(54) ADJUSTING GLOSS FOR A PRINT IMAGE

(75) Inventors: Knut Behnke, Flintbek (DE); Hans-Otto Krause, Eckernförde (DE); Frank-Michael Morgenweck, Molfsee (DE); Domingo Rohde, Kiel (DE); Detlef Schulze-Hagenest, Molfsee (DE); Lars Seimetz, Achterwehr (DE); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 170 days.

(21) Appl. No.: 10/822,329

(22) Filed: Apr. 12, 2004

(65) Prior Publication Data

US 2005/0226663 A1 Oct. 13, 2005

(51) Int. Cl.
*G03G 15/20* (2006.01)

(52) U.S. Cl. ..... 399/341; 399/45; 399/69; 430/108.8; 430/124

(58) Field of Classification Search ..... 399/45, 399/341, 67, 320, 69; 347/156; 430/105, 430/108.8

See application file for complete search history.

(56) References Cited

U.S. PATENT DOCUMENTS

| | | | | |
|---|---|---|---|---|
| 4,533,614 | A * | 8/1985 | Fukumoto et al. | 430/124 X |
| 5,099,288 | A * | 3/1992 | Britto et al. | 399/320 |
| 5,164,782 | A * | 11/1992 | Nagayama et al. | 399/320 |
| 5,318,670 | A | 6/1994 | Linke et al. | 162/206 |
| 5,805,969 | A * | 9/1998 | Elsermans et al. | 399/341 |
| 6,130,018 | A * | 10/2000 | Kawata et al. | 430/111.35 |
| 6,403,273 | B1 * | 6/2002 | Ting et al. | 430/108.8 |
| 2001/0051704 | A1 * | 12/2001 | Maekawa et al. | 528/80 |
| 2003/0027073 | A1 * | 2/2003 | Serizawa et al. | 430/124 |
| 2004/0057741 | A1 * | 3/2004 | Uehara et al. | 399/69 |
| 2004/0132920 | A1 * | 7/2004 | Matsumura et al. | 525/418 |

FOREIGN PATENT DOCUMENTS

| | | | |
|---|---|---|---|
| EP | 0 848 304 | A2 | 6/1998 |
| JP | 9-160311 | | 6/1997 |
| JP | 2004-85634 | | 3/2004 |
| JP | 2004-085882 | A * | 3/2004 |

* cited by examiner

*Primary Examiner*—Sophia S. Chen
(74) *Attorney, Agent, or Firm*—Lawrence P. Kessler

(57) ABSTRACT

Adjusting a gloss for a print image by adjusting the cooling of the print image. Further, a toner for a printing press adjusting gloss by adjusting cooling includes 1% to 30% aliphatic hydrocarbons, aliphatic acids, aliphatic alcohols or their salts, or olefinic hydrocarbons.

11 Claims, 1 Drawing Sheet

ADJUSTING GLOSS FOR A PRINT IMAGE

FIELD OF THE INVENTION

The invention relates to fusing a print image wherein the gloss of the print image is adjusted by controlling the cooling of the print image.

BACKGROUND OF THE INVENTION

In industrial printing technology, the requirements relating to the quality of the print image are growing. An important quality characteristic of a print is its gloss. The gloss arises if light falling on the surface of a print is reflected in a more or less directed manner, into the eye of the observer. To distinguish between surfaces with matt, medium, and high gloss, it is usually sufficient to measure the directed reflection with a reflectometer. Besides the use of certain inks and toner to attain a certain gloss, the prior art also proposes changing the speed and temperature of fusing rollers. Here, the speed and the temperature at which the fusing of the toner of the print image on print material is performed, and the attachment or union of the toner with the print material, are varied. A disadvantage of this process is that the speed of the print material in the printing press changes with the speed of the fusing rollers applied to it. This significantly complicates the control of the printing press and its construction.

SUMMARY OF THE INVENTION

The objective of the invention is to adjust the gloss of a print image. The adjustment of the gloss of the print image is accomplished by controlling the cooling of the print image.

BRIEF DESCRIPTION OF THE DRAWINGS

Examples of the invention are described in detail hereafter based on the figures in which.

DETAILED DESCRIPTION OF THE INVENTION

Figure 1:
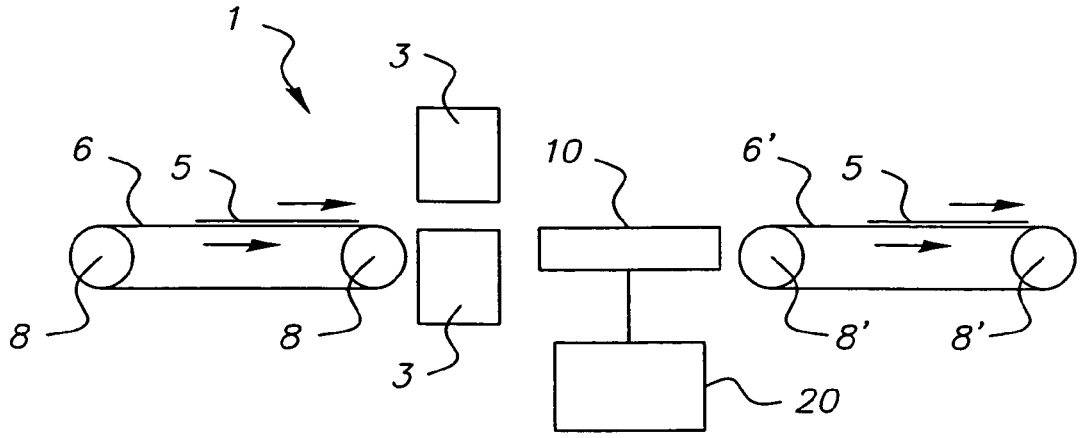
FIG. 1 is a schematic view of a fusing device of a printing press for adjusting the gloss of a print image according to this invention.

FIG. 1 shows a schematic view of a fusing device 1, according to the invention, for fusing a print image on a print material 5. During the fusing procedure, the print image, which consists here of a toner, is securely joined to the surface of the print material 5. The fusing procedure is carried out after the application of the toner print image on the print material 5, and before the collection of the completed print material 5, or further processing steps, such as cutting or binding.

An endless conveyor belt 6, which is entrained in tension about deflection rolls 8 (at least one of which is driven), conveys the print material 5 in the direction of the arrows through the printing press to the fusing device 1, which includes a heating device 3, in this example, a microwave device. The print material 5 is fed through openings or slits in the heating device 3. In the heating device 3, a microwave field is formed in this example preferably by a resonant microwave field with standing waves. The microwave radiation exerts a heating effect on the print material 5 with a toner print image, thus heating the toner in this manner. The toner is heated in this procedure from about 80° C. to 140° C., preferably from 100° C. to 120° C. The heating effect essentially influences the fusing of the toner on the print material 5. Of course other suitable fusing devices can be used with this invention, such as, particularly heated rollers for use of pressure and heat on the print material 5 with toner.

The print material 5, customarily a sheet of paper with a predetermined weight, is conveyed in a contactless manner through the fusing device 1, for example, on an air cushion. Downstream of the fusing device 1, as viewed in the direction of the print material transport, a cooling device 10 is arranged upon which the print material 5 is subsequently conveyed. The cooling device 10 conveys the print material 5 in a contacting manner and has a high heat conductivity. Alternatively, of course, the cooling of the print material 5 can be performed according to this invention in a contactless manner so that the print material 5 during the cooling procedure does not have any contact to parts of the cooling device 10. In this alternative embodiment, the cooling device 10 includes, for example, an air-cushion device that supports the print material 5 in a contactless manner. This is beneficial, particularly in duplex printing (printing of both sides of the print material 5) if the printed side is oriented downwards and there is a risk of smearing the print image through contact with the conveyor belt 6 or through printing press parts.

The cooling of the print material 5 with the applied toner has the essential objective of concluding the fusing step, in that the still warm and smearable toner is solidified and essentially attached in a secure manner on the print material 5 before it can be smeared. During the cooling procedure, the toner experiences a characteristic viscosity curve until it has solidified. Without cooling the print material 5, the print image can be damaged through contact with printing press parts in the transport path. Downstream of the cooling device 10, another endless conveyor belt 6' is arranged that is entrained in tension about deflection rollers 8', and which further transports the print material 5 in the printing press in the direction of the arrows.

The cooling device 10, is controlled by a control unit 20 (e.g. a microprocessor-based logic and control unit) of a printing press so that it influences the gloss of the print image on the print material 5. For this purpose, the cooling device 10 has different cooling strengths, and the cooling power of the cooling device 10 is adjustable. The cooling rate is defined in terms of cooling in degrees Kelvin per second (° K/s). This cooling rate of the cooling device 10 is adjusted by the control unit 20 to provide desired gloss. As provided by a look-up table for the control unit 20 certain cooling rates are respectively associated with desired gloss in the final print image on predetermined print material; for example, a predetermined higher cooling rate is associated with a higher gloss, rather than a lower gloss.

According to the invention during fusing, a toner is used, preferably one that includes 1% to 30% of an aliphatic hydrocarbon, an aliphatic acid, an aliphatic alcohol or one of its salts, or of preferably 10% to 20% or 15% to 25% of an olefinic hydrocarbon. Moreover, the toner includes a resin, preferably a polyester resin, optionally, a pigment or a dyestuff, optionally a material for forming an electrostatic charge, and optionally a flow expedient (or alternativly, a solvent). The aliphatic hydrocarbons, acids, alcohols, and their salts include, for example, stearamides, stearic acid, erucamides, oleamides, (N,N' ethylene to oleamide), arachidamides, beheniamides, stearyl erucamides, stearyl steramides, (N,N' ethylene to stearamides), stearone and tristearin. For example, a dry toner can be used which becomes quite hard at an average temperature of 60° C. or 80° C. so that it can be ground using conventional methods, into a desired toner particle size of, for example, 8 micrometers and will not melt at temperatures used when applying the print image, but rather at higher temperatures of, for example, about 110° C. or about 130° C. At such temperatures, the toner suddenly becomes very fluid with a low viscosity so that it settles and adheres, possibly through the use of capillarities, even without mechanical pressure on the print material 5 in a contactless manner. The toner becomes hard very quickly upon cooling and is then fused to the print material 5, with a good surface gloss of the print image being attained. A specially used toner has the value of an elastic module G' at a reference temperature value, computed from the initial temperature at the start of the glass transition of the toner plus 50° K, i.e., (G'(reference temperature value)/G'(reference temperature value +50° K)) of less than $10^{-5}$, preferably of $10^{-7}$. The transition of the toner from its fixed state to its fluid state takes place preferably, with a temperature of about 30° K, but preferably within a temperature range from around 70° C. to around 130° C.

Figure 2:
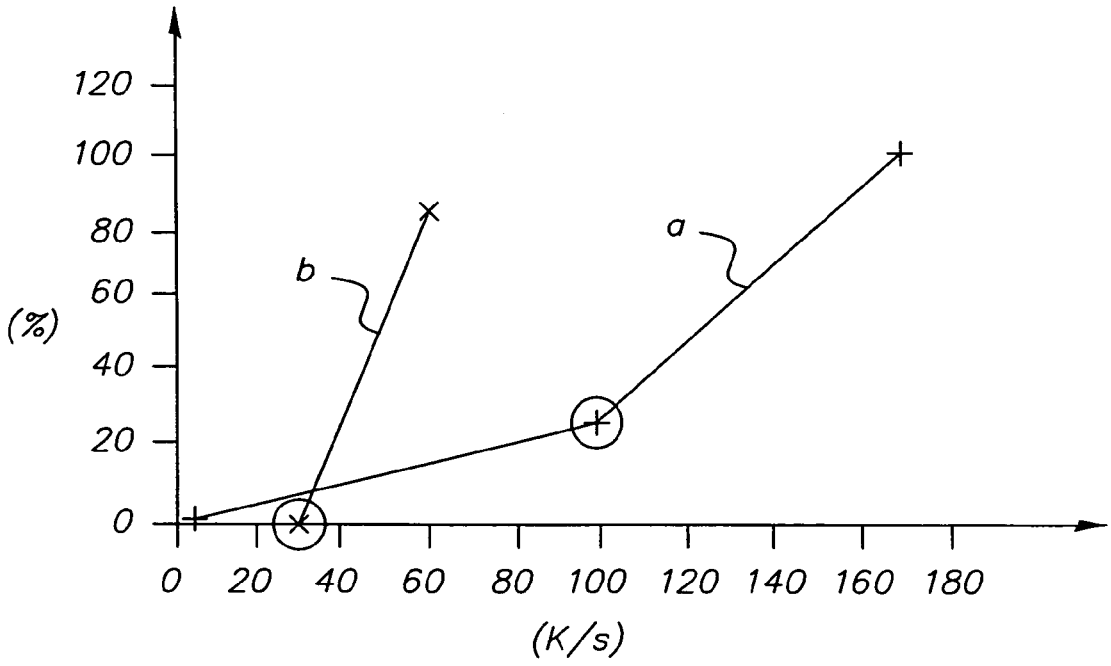
FIG. 2 is a graphical representation of two functional curves of the gloss increase as a function of the cooling rate.

FIG. 2 is a graphical representation of two functional curves for gloss increase as a function of the cooling rate for two different print materials 5; a first functional curve is designated as a and a second functional curve as b. The functional curves a and b in each case designate a certain predetermined print material 5; the functional curve a designates a wood-free, gloss-coated paper with a basic weight of 135 g/m$^2$, and the functional curve b designates a wood-free, gloss-coated paper with a basic weight of 300 g/m$^2$. The toner used is different for the two functional curves a, b.

The gloss is measured in this connection at an angle of about 60°, with respect to the surface of the print material 5. The gloss increase on the ordinate of the coordinate system designates the increase of the gloss of the print image, in relation to the gloss of the print material 5 as a percentage, and ranges for the curve a from zero to 120 percent in this representation. The cooling rate plotted on the abscissa designates the cooling of the print material 5 in the quantities and temperature in relation to time, here in degrees Kelvin per second (° K/s). Accordingly, higher cooling rates mean shorter times for cooling.

The shapes of curves a and b are measured at an angle of 60°, with respect to the print material surface. The shape of curve a, is initially in the range from around zero to 100° K/s with a slight continuous upwards trend. At a cooling rate of around 100° K/s, the curve shape becomes surprisingly steeper and continues to climb continuously. At a cooling rate of 100° K/s in the curve a, a gloss increase of the print image consisting of the toner of about 24% is present, in comparison to the gloss of print material 5. At a cooling rate of 120° K/s, the gloss increase is already around 45%, i.e., for an increase in the cooling rate from 100° K/s to 120° K/s, nearly a doubling of the gloss increase occurs, in comparison to an increase in the cooling rate from about zero to about 100° K/s. A technically significant change in the cooling rate, for example, from 40° K/s to 60° K/s leads the curve a only a small gloss change of about 5% to occur, which is of little significance in terms of adjusting the gloss. The cooling device 10 is controlled in case of the presence of the functional curve, according to curve a, such that the cooling rate lies in the range of 100° K/s to 120° K/s, depending on the desired gloss of the print image, so that even small changes in the cooling rate lead to large changes in the gloss increase. This insight is of particular interest when fusing a print image on a print material 5, particularly in digital printing presses.

The curve b, according to FIG. 2 for another print material 5 in comparison to the curve a, extends at low cooling rates to around 30° K/s with a nearly unchanged gloss increase in comparison to the gloss of the print material 5 near the abscissa. At a temperature of around 30° K/s, the functional curve rises continuously in a steep manner until it has reached a cooling rate of around 60° K/s, a gloss increase of about 85% in relation to the gloss of the print material 5.

Both curves a and b have recognizable values at which a surprisingly significant change in the curve shape occurs that becomes significantly steeper at these values. These values of the curves a and b are circled for illustration purposes in FIG. 2 and divide the curves a and b in terms of the control of the cooling device 10 in each case into two regions: one region below the circled value and one region above the circled value. Below the circled value, the cooling device 10 is operated if no gloss change is desired and above the circled value the cooling device 10 is operated if a gloss change is desired.

In concrete terms, in case of a print order, the desired gloss of a print image is entered by an operator of the printing press into the control unit 20 of the printing press. According to the invention, using these entries by the operator, the cooling device 10 is controlled as a function of the paper type and the basic paper weight, and makes available a certain cooling power that leads to a certain cooling rate in the fusing device 1. Finally, the cooling rate has significant influence on the gloss of the print image on the print material 5. The speed of the print material 5 transported through the fusing device 1 is essentially the same, so that no influences of the gloss on the print image occur due to variable speeds. In this manner, the gloss of a print image is adjusted in a controlled manner on the printing press. In the case where no essential gloss change of the print image is desired during the printing operation, for the presence of the special print material 5 with toner which exhibits the curve a, the cooling rate on the cooling device 10 is adjusted in the range of zero to around 100° K/s, by supplying a low cooling power. In the other case, if a gloss change of the print image is desired in a special printing procedure or print order in terms of the curve a, a cooling rate ranging above a cooling rate of around 100° K/s is set on the cooling device 10 by supplying a higher cooling power. Depending on the desired gloss of the print image on the print material 5, a specific cooling rate is used.

With regard to the curve b, a cooling rate of about 35° K/s is set on the cooling device 10 if no gloss change in the print image is desired, since the gloss in this range remains roughly constant. If a gloss increase in the print image in relation to the print material is desired, then a cooling rate of around 35° K/s to around 60° K/s is set on the cooling device 10, depending on the size of the desired gloss increase. The values at which the curves a and b suddenly change their shape and climb in a steeper manner, at around 100° K/s or around 35° K/s, are dependent on both the print material and the toner, as described, and accordingly have a significant influence on the region in which the cooling rate of the cooling device 10 is operated, in each case. As a general rule, there are two regions of the cooling rates: one region below the value at which the curves a and b have a noticeable change in shape and one region above this value.

The invention has been described in detail with particular reference to certain preferred embodiments thereof, but it will be understood that variations and modifications can be effected within the spirit and scope of the invention.

What is claimed is:

1. A method for adjusting a gloss for a print image, comprising: adjusting the gloss of a print image by adjusting the cooling of the print image, wherein for an essentially constant gloss of a print image to occur, a cooling rate below a value which is dependent on a predetermined print material and a predetermined toner is chosen.

2. The method according to claim 1, wherein a toner used is heated prior to the cooling procedure from around 80° C. to 140° C., but preferably from 110° C. to 135° C.

3. The method according to claim 1, wherein for an increase of the gloss of a print, image to occur, a cooling rate above a value, which is dependent on the print material and a predetermined toner is chosen.

4. A fusing device for a printing press, having a heating device for heating a toner including 1% to 30% aliphatic hydrocarbons, aliphatic acids, aliphatic alcohols or their salts or olefinic hydrocarbons on a print material, comprising: a cooling device, and a control unit for adjustably cooling a print image wherein the gloss of the print image is adjusted, wherein the toner has the value of an elastic module G' at a reference temperature value, computed from the initial temperature at the start of the glass transition of the tones plus 50° K, i.e., (G'(reference temperature value)/G'(reference temperature value +50° K)) of less than $10^{-5}$.

5. The toner for a printing press according to claim 4, wherein the toner includes 5% to 25% of the aliphatic hydrocarbons, aliphatic acids, aliphatic alcohols or their salts, or the olefinic hydrocarbons.

6. The toner for a printing press according to claim 5, wherein the toner includes 10% to 20% of the aliphatic hydrocarbons, aliphatic acids, aliphatic alcohols or their salts, or the olefinic hydrocarbons.

7. The toner according to claim 4, wherein the toner includes 15% to 25% of the aliphatic hydrocarbons, aliphatic acids, aliphatic alcohols or their salts, or the olefinic hydrocarbons.

8. The toner according to claim 4, wherein the toner includes at least a resin, particularly a polyester resin.

9. The toner according to claim 4, wherein the toner includes at least a pigment or a dyestuff.

10. The toner according to claim 4, wherein the toner includes at least a material for forming an electrical charge.

11. The toner according to claim 4, wherein the toner contains at least a flow expedient or a solvent.

* * * * *